US005257838A

United States Patent [19]

Lin

[11] Patent Number: 5,257,838

[45] Date of Patent: Nov. 2, 1993

[54] DEAD BOLT ASSEMBLY FOR TUBULAR DOOR LOCKS

[76] Inventor: Jui-Chang Lin, #55-10 Been Chou Rd., Kangshan, Kaohsiung Hsien, Taiwan

[21] Appl. No.: 980,976

[22] Filed: Nov. 24, 1992

[51] Int. Cl.[5] ..... E05C 1/16

[52] U.S. Cl. ..... 292/1.5; 292/DIG. 61

[58] Field of Search ..... 292/1.5, 152, DIG. 60, 292/DIG. 61, 337

[56] References Cited

U.S. PATENT DOCUMENTS

| | | | |
|---|---|---|---|
| 663,503 | 12/1900 | Laureyns | 292/1.5 X |
| 4,639,025 | 1/1987 | Fann et al. | 292/337 |
| 4,804,216 | 2/1989 | Marotto | 292/337 |
| 4,850,626 | 7/1989 | Gallego | 292/337 |
| 4,890,871 | 1/1990 | Lin | 292/337 |
| 4,927,195 | 5/1990 | Wu et al. | 292/169.14 |
| 4,927,199 | 5/1990 | Wu et al. | 292/337 |
| 4,976,122 | 12/1990 | Doolan et al. | 292/1.5 X |
| 5,002,319 | 3/1991 | Chandler | 292/17 |
| 5,169,184 | 12/1992 | Bishop | 292/1.5 |

*Primary Examiner*—Richard E. Moore

*Attorney, Agent, or Firm*—Jacobson, Price, Holman & Stern

[57] ABSTRACT

A door lock includes a dead bolt slidably received in a cylinder and including a pair of extensions extended outward beyond the cylinder, a pair of plates fixed to the cylinder, an oblong hole formed in each of the plates, an actuating wheel slidably engaged in the oblong holes of the plates and including a pair of teeth for engagement with the protrusions of the extensions when the actuating wheel rotates. A resilient member is fixed to one of the plates for positioning the actuating wheel.

6 Claims, 4 Drawing Sheets

DEAD BOLT ASSEMBLY FOR TUBULAR DOOR LOCKS

BACKGROUND OF THE INVENTION (a) Field of the Invention

The present invention relates to a dead bolt assembly, and more particularly to a dead bolt assembly for a tubular door lock.

(b) Description of the Prior Art

Various kinds of tubular door locks have been developed and widely used, some of which are disclosed in the following U.S. Pat. Nos.: 4,639,025 to Fann et al., filed Mar. 17, 1986, entitled "ADJUSTABLE DEAD BOLT ASSEMBLY"; 4,804,216 to Marotto, filed Feb. 1, 1988, entitled "CONVERTIBLE BACKSET LATCH MECHANISM"; 4,850,626 to Gallego, filed Mar. 2, 1988, entitled "IMPROVED LATCH BOLT WITH SELECTIVELY VARIABLE DRIVING PIN DEPTH"; 4,890,871 to Lin, filed Nov. 17, 1988, entitled "TUBULAR DOOR LOCK WITH AN ADJUSTABLE DEVICE FOR SETTING THE DEAD BOLT"; 4,927,195 to Wu et al., filed Nov. 8, 1988, entitled "DUAL BACKSET DEADBOLT ASSEMBLY"; and 4,927,199 to Wu et al., filed Sep. 23, 1988, entitled "LATCH ASSEMBLY FOR CYLINDER LOCK". In these patents, the configurations thereof are complicated and can further be simplified such that the manufacturing fees thereof can be decreased.

The present invention has arisen to mitigate and/or obviate the afore-described disadvantages of the conventional tubular door locks.

SUMMARY OF THE INVENTION

The primary objective of the present invention is to provide a dead bolt assembly for a tubular door lock which has a simplified configuration and a reduced manufacturing fee.

In accordance with one aspect of the present invention, there is provided a dead bolt assembly comprising a lock case including a cylinder, a dead bolt slidably received in the cylinder and including a pair of extensions extended outward beyond the cylinder, each of the extensions including a pair of protrusions extended therefrom, a pair of plates fixed to the cylinder and each including an oblong hole formed therein, each of the oblong holes including two end portions, and an actuating wheel slidably engaged in the oblong holes of the plates and slidable between the end portions of the oblong holes and slidable between the extensions of the dead bolt, the actuating wheel including a pair of teeth for engagement with the protrusions of the extensions when the actuating wheel rotates.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
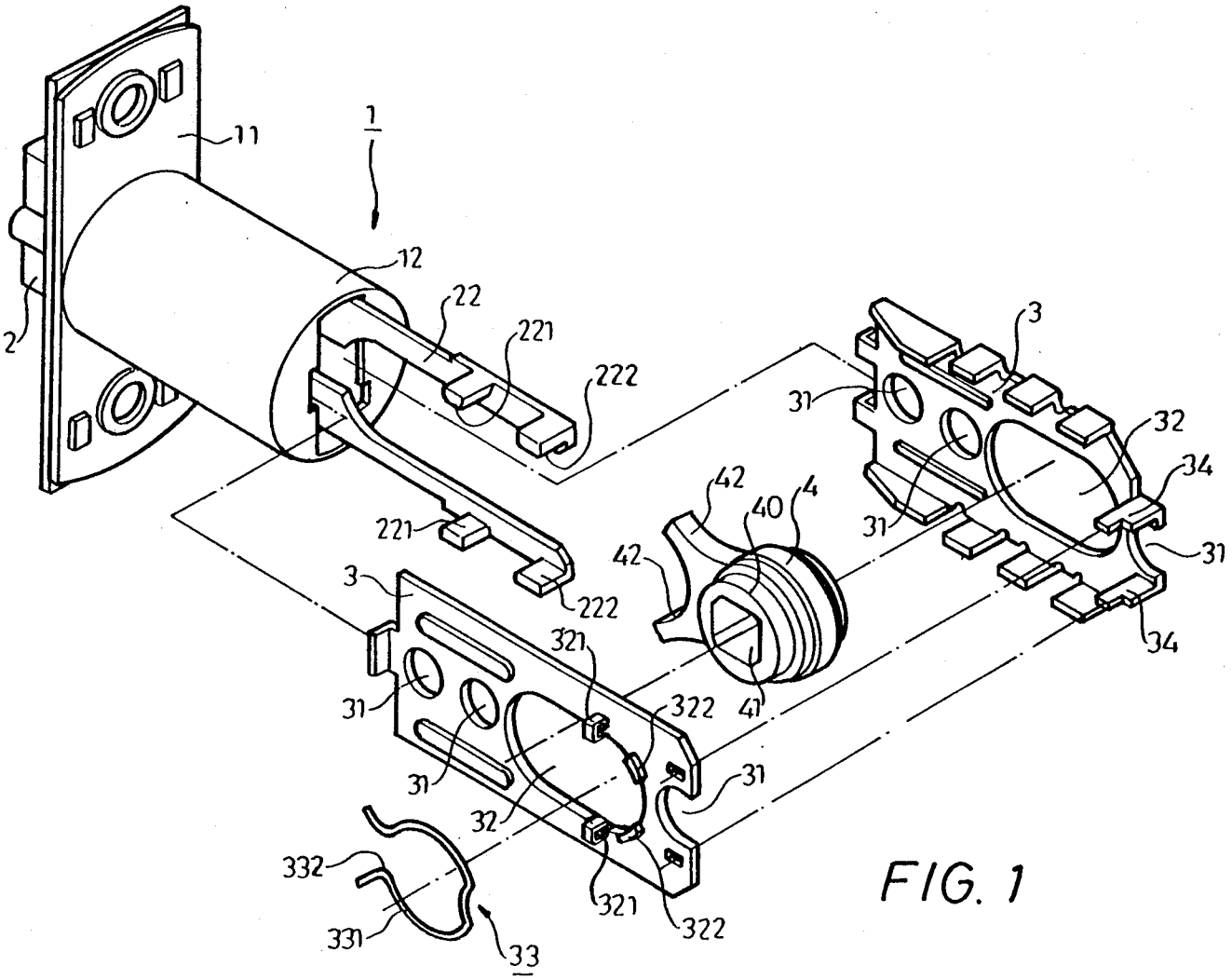
FIG. 1 is an exploded view of a dead bolt assembly for a tubular door lock in accordance with the present invention.
Figure 2:
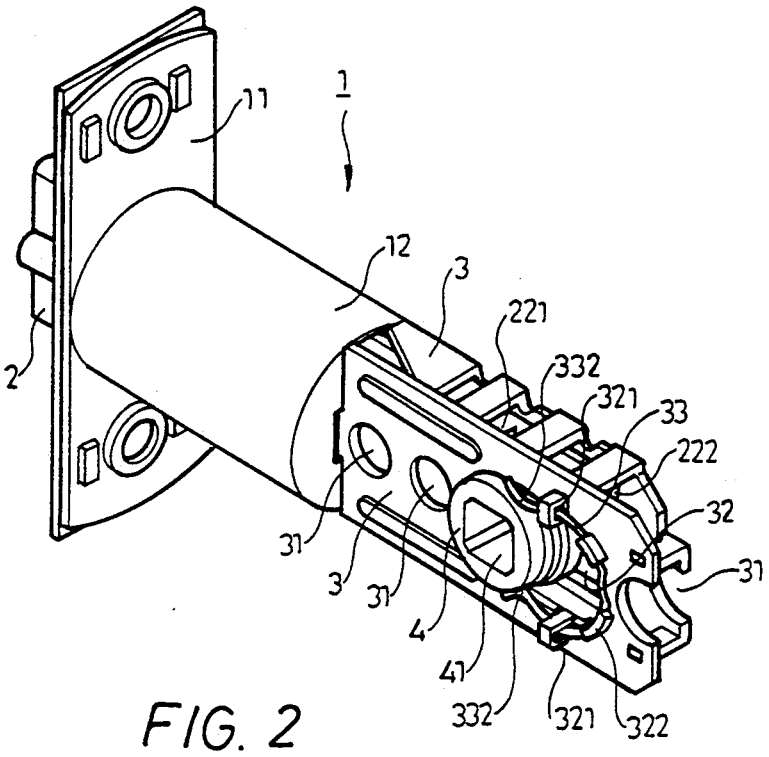
FIGS. 2 and 3 are perspective views illustrating the operations of the dead bolt assembly as shown in FIG. 1.
Figure 3:
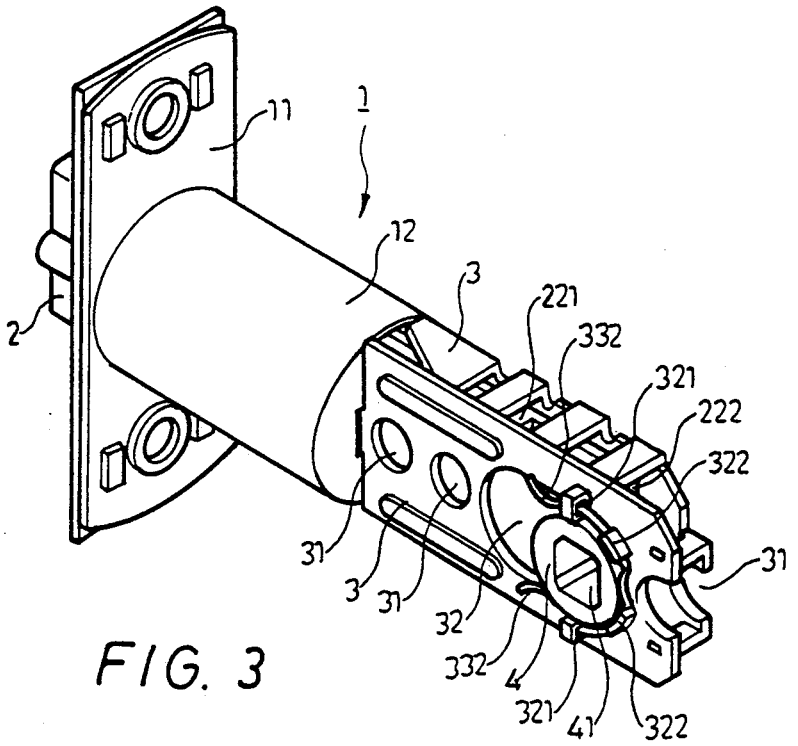

Referring to the drawings and initially to FIGS. 1 to 3, a dead bolt assembly for a tubular door lock in accordance with the present invention comprises generally a lock case 1, a dead bolt 2 accommodated within the lock case 1, a pair of plates 3 coupled to the lock case 1 and an actuating wheel 4 engageable with the dead bolt 2 for operating the dead bolt 2.

The lock case 1 includes a face plate 11 and a cylinder 12 for accommodating the dead bolt 2, the dead bolt 2 including a pair of extensions 22 extended outward through the cylinder 12, each of the extensions 22 including a pair of protrusions 221, 222 extended therefrom. The actuating wheel 4 includes a square hole 41 formed in the center thereof for insertion of the square shaft of the door lock (not shown) so that the actuating wheel 4 can be rotated and includes a pair of teeth 42 for engagement with the protrusions 221, 222 of the extensions 22 when the actuating wheel 4 rotates.

The plates 3 are fixed to the cylinder 12, or otherwise, formed integral with the cylinder 12. Each of the plates 3 includes three openings 31 formed therein for fixing the plates 3 to the door (not shown) such that the plates 3 and the lock case 1 are fixed within the door, and includes an oblong hole 32 formed therein for slidably engagement with a pair of shoulders 40 formed in the side portions of the actuating wheel 4. One of the plates 3 includes a pair of loops or hooks 321 and a pair of stops 322, a resilient member 33 is engaged with and is stably retained in place by the hooks 321 and the stops 322 of the plate 3, the resilient member 33 includes two legs 331 resiliently engaged with the actuating wheel 4 and a throat portion 332 having a distance smaller than the outer diameter of the actuating wheel 4, the throat portion 332 is located in the middle portion of the oblong hole 32 for positioning the actuating wheel 4; i.e., the actuating wheel 4 may move through the throat portion 332 of the resilient member 33 and may move between the end portions of the oblong holes 32 and may be positioned in the end portions of the oblong holes 32 by the throat portion 332 of the resilient member 33.

Figure 4:
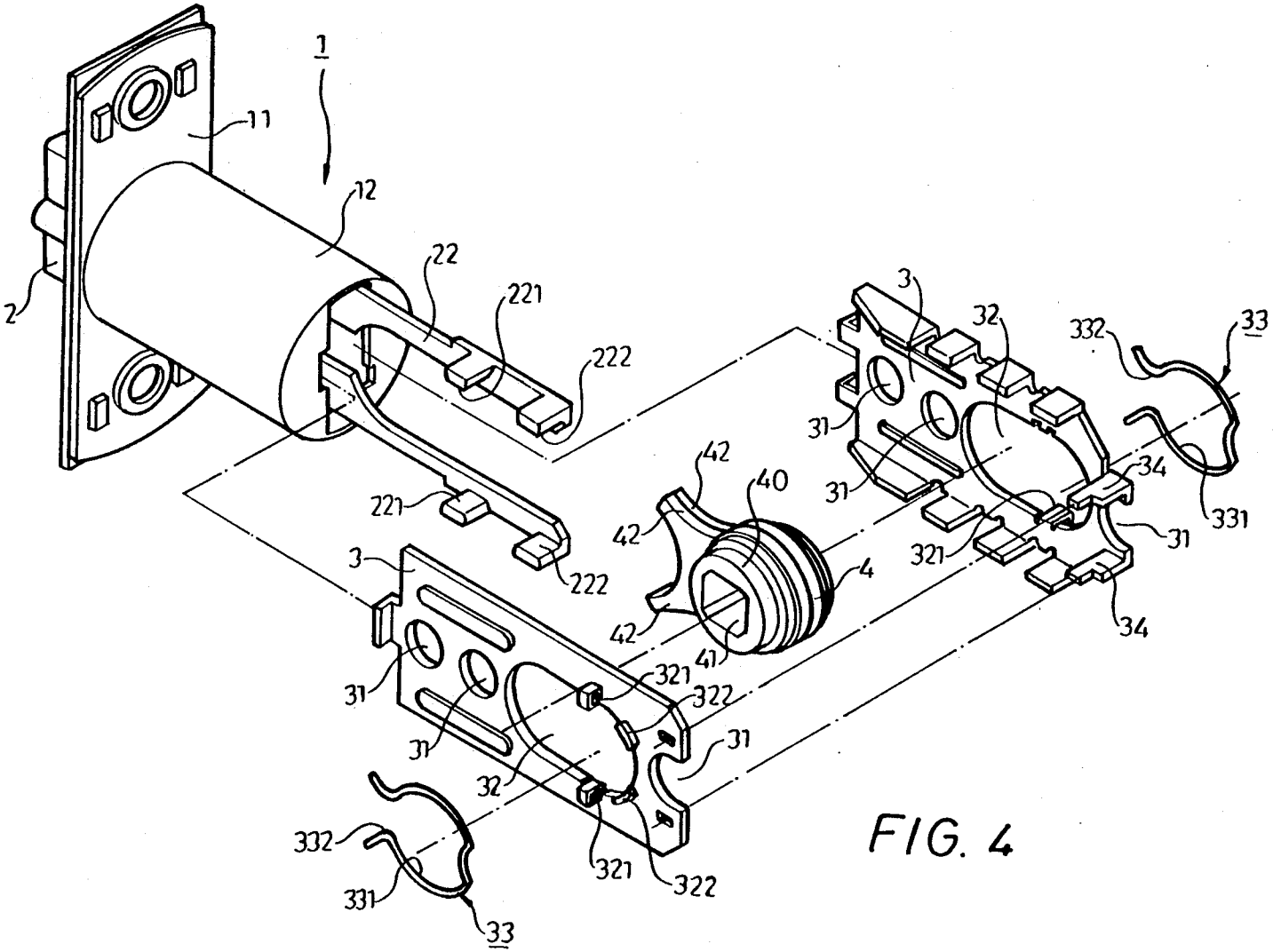
FIG. 4 is an exploded view in accordance with another embodiment of the present invention.

Referring next to FIG. 4, illustrated is another embodiment of the present invention which is almost identical to the embodiment as shown in FIGS. 1 to 3, except that two resilient members 33 are used and each fixed to the respective plate 3, and the actuating wheel 4 includes two halves each independently and slidably engaged in the respective oblong holes 32 of the plates 3 and engaged with the resilient members 33 such that the extensions 22 can be actuated by either half of the actuating wheel 4.

Figure 5:
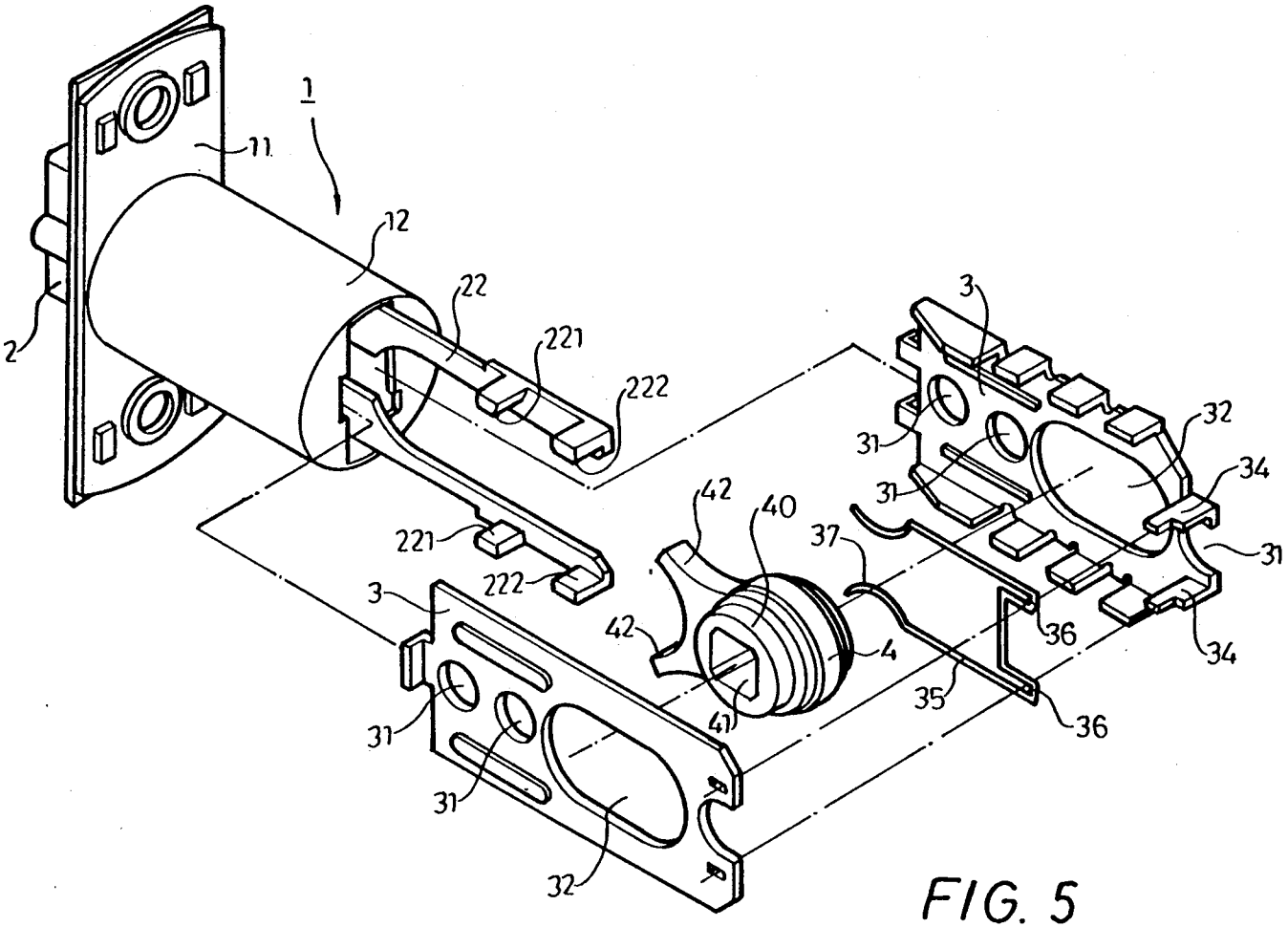
FIG. 5 is an exploded view in accordance with a further embodiment of the present invention.

Referring next to FIG. 5, illustrated is a further embodiment of the present invention which is almost identical to the embodiment as shown in FIGS. 1 to 3, except that a resilient member 35 of slightly different shape from the resilient member 33 is used, one of the plates 3 includes a pair of limbs 34 laterally extended therefrom for engagement with the other plate 3, the resilient member 35 includes two channels 36 for engagement with the limbs 34 of the plate 3 and includes a throat portion 37 engageable with the actuating wheel 4 so as to position the actuating wheel 4.

It is to be noted that the oblong holes 32 are provided such that actuating wheel 4 may slide to either of the end portions of the oblong holes 32, this is particular appreciated for assembling the door locks having different sizes. However, the actuating wheel 4 is engaged on the square shaft of the door lock and can be stably retained in place by the square shaft, such that, without the resilient member 33, 35, the actuating wheel 4 can also be positioned. The resilient members 33, 35 are provided for further stably positioning the actuating wheel 4.

Accordingly, the dead bolt assembly for a tubular door lock in accordance with the present invention has a simplified configuration which thus decreases the manufacturing cost thereof.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dead bolt assembly comprising a lock case including a cylinder, a dead bolt slidably received in said cylinder and including a pair of extensions extended outward beyond said cylinder, each of said extensions including a pair of protrusions extended therefrom, a pair of plates fixed to said cylinder and each including an oblong hole formed therein, each of said oblong holes including two end portions, and an actuating wheel slidably engaged in said oblong holes of said plates and slidable between said end portions of said oblong holes and slidable between said extensions of said dead bolt, said actuating wheel including a pair of teeth for engagement with said protrusions of said extensions when said actuating wheel rotates, the assembly further comprising means for positioning said actuating wheel, wherein said positioning means includes a resilient member fixed to a first plate of said plates, said resilient member includes a throat portion located in a middle portion of said oblong hole of said first plate for positioning said actuating wheel.

2. A dead bolt assembly according to claim 1, wherein said first plate includes a pair of hooks and a pair of stops formed thereon, said resilient member is engaged with and supported by said hooks and said stops and arranged such that said throat portion is located in said middle portion of said oblong hole of said first plate.

3. A dead bolt assembly comprising a lock case including a cylinder, a dead bolt slidably received in said cylinder and including a pair of extensions extended outward beyond said cylinder, each of said extensions including a pair of protrusions extended therefrom, a pair of plates fixed to said cylinder and each including an oblong hole formed therein, each of said oblong holes including two end portions, and an actuating wheel slidably engaged in said oblong holes of said plates and slidable between said end portions of said oblong holes and slidable between said extensions of said dead bolt, said actuating wheel including a pair of teeth for engagement with said protrusions of said extensions when said actuating wheel rotates, the assembly further comprising means for positioning said actuating wheel, wherein said positioning means includes a resilient member fixed to each of said plates, said actuating wheel includes two halves each slidably engaged in said oblong hole of a respective plate, each of said resilient members includes a throat portion located in a middle portion of said oblong hole of said plates for positioning a respective half of said actuating wheel.

4. A dead bolt assembly according to claim 3, wherein each of said plates includes a pair of hooks and a pair of stops formed thereon, each of said resilient members is engaged with and supported by said hooks and said stops of a respective plate.

5. A dead bolt assembly comprising a lock case including a cylinder, a dead bolt slidably received in said cylinder and including a pair of extensions extended outward beyond said cylinder, each of said extensions including a pair of protrusions extended therefrom, a pair of plates fixed to said cylinder and each including an oblong hole formed therein, each of said oblong holes including two end portions, and an actuating wheel slidably engaged in said oblong holes of said plates and slidable between said end portions of said oblong holes and slidable between said extensions of said dead bolt, said actuating wheel including a pair of teeth for engagement with said protrusions of said extensions when said actuating wheel rotates, the assembly further comprising means for positioning said actuating wheel wherein said positioning means includes a resilient member fixed between said plates and including a throat portion located in a middle portion of said oblong holes of said plates for positioning said actuating wheel.

6. A dead bolt assembly according to claim 5, wherein said first plate includes a pair of limbs extended laterally therefrom for engagement with a second plate of said plates, said resilient member includes a pair of channels engaged with said limbs of said first plate so that said resilient member is fixed to said first plate and is retained between said plates.

* * * * *